US006163911A

United States Patent [19]

Lin

[11] Patent Number: 6,163,911

[45] Date of Patent: Dec. 26, 2000

[54] LOCATING STRUCTURE OF EXPANDABLE MAGNETIC ROD OF SCREWDRIVER

[76] Inventor: Chang-Ming Lin, 331, Chan Chun St., Chiu Te Village, Wu Jih Hsiang, Taichung Hsien, Taiwan

[21] Appl. No.: 09/418,845

[22] Filed: Oct. 15, 1999

[51] Int. Cl.[7] ..... B25B 15/00

[52] U.S. Cl. ..... 7/165; 81/439; 81/490; 81/177.4

[58] Field of Search ..... 7/138, 165, 901; 81/439, 490, 177.4

[56] References Cited

U.S. PATENT DOCUMENTS

| | | | |
|---|---|---|---|
| 5,592,862 | 1/1997 | Macor | 81/439 X |
| 5,896,606 | 4/1999 | Huang | 7/165 |
| 5,901,622 | 5/1999 | Sweeny | 7/165 X |
| 5,916,341 | 6/1999 | Lin | 81/439 X |
| 5,927,162 | 7/1999 | Huang | 81/490 X |

*Primary Examiner*—James G. Smith
*Attorney, Agent, or Firm*—Harrison & Egbert

[57] ABSTRACT

A screwdriver includes a handle, a shank, and a locating seat which is provided with a plurality of receiving holes for receiving a tip. The shank is provided at the free end thereof with an opening for fastening the tip. The handle is provided with a through hole which is in communication with one of the receiving holes of the locating seat and is extended to reach the bottom end of the handle. The handle is further provided with a longitudinally-oriented slot in communication with the through hole. An expandable magnetic rod is received in one of the receiving holes, the through hole and the slot such that the expandable magnetic rod is fastened by a screw, and that a magnetic tip of the expandable magnetic rod is exposed from the seat. The handle is further provided with a cover.

4 Claims, 7 Drawing Sheets

LOCATING STRUCTURE OF EXPANDABLE MAGNETIC ROD OF SCREWDRIVER

FIELD OF THE INVENTION

The present invention relates generally to an expandable magnetic rod of a screwdriver, and more particularly to a structure for locating the expandable magnetic rod of the screwdriver.

BACKGROUND OF THE INVENTION

As shown in FIGS. 1–3, a prior art screwdriver comprises a shank 10, a handle 11 fastened with one end of the shank 10, and a tip 16 fastened with other end of the shank 10. The shank 10 has a hollow interior 12 in which an expandable rod 14 is disposed. The shank 10 has an open end 13 through which the expandable rod 14 is extracted or retracted. The expandable rod 14 is provided at the outer end thereof with a magnetic element 15 fastened therewith for attracting a screw which is located at a hard-to-reach place.

Such a prior art screwdriver as described above is defective in design in that the expandable rod 14 and the tip 16 interfere with each other when the screwdriver is in use or when the tip 16 of one size is replaced with the tip 16 of another size.

SUMMARY OF THE INVENTION

The primary objective of the present invention is to provide a screwdriver free from the drawbacks of the prior art screwdriver described above.

The objective, feature and function of the present invention will be readily understood upon a thoughtful deliberation of the following detailed description of a preferred embodiment of the present invention with reference to the accompanying drawings.

DETAILED DESCRIPTION OF THE EMBODIMENT

Figure 1:
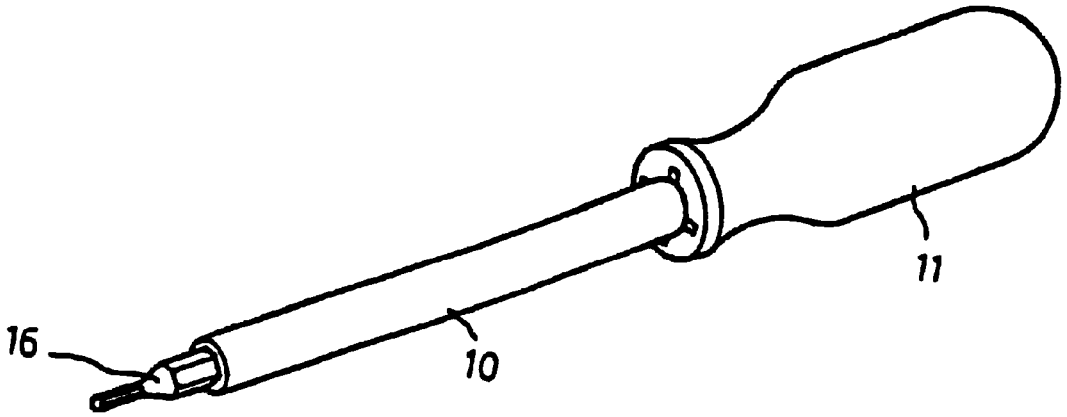
FIG.1 PRIOR ART
FIG. 1 shows a perspective view of a screwdriver of the prior art.
Figure 2:
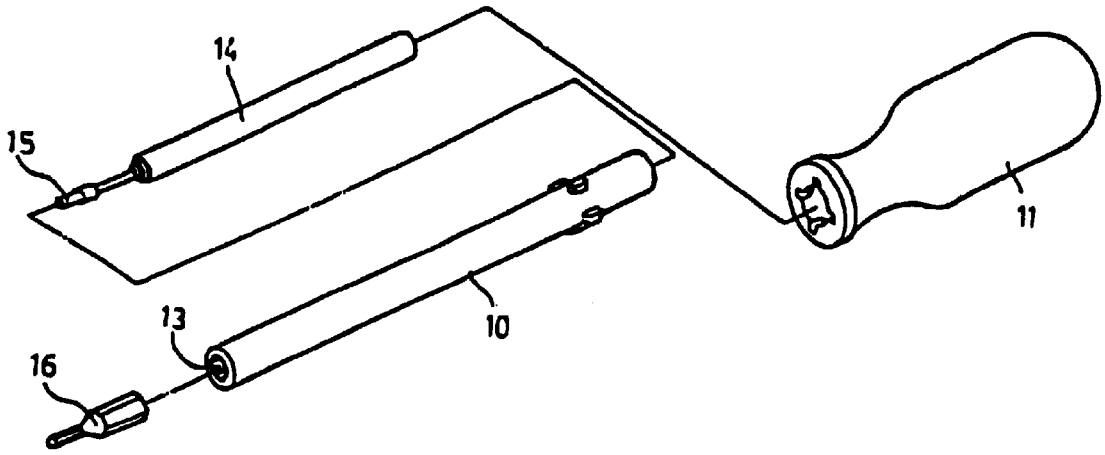
FIG.2 PRIOR ART
FIG. 2 shows an exploded view of the screwdriver of the prior art.
Figure 3:
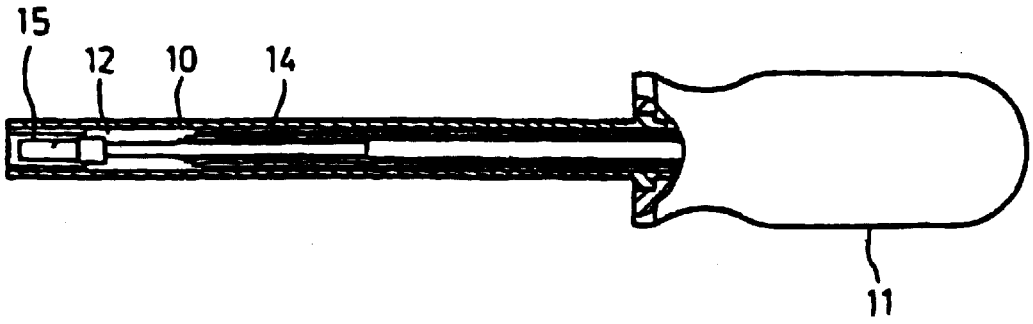
FIG.3 PRIOR ART
FIG. 3 shows a longitudinal sectional view of the prior art screwdriver in combination.
Figure 4:
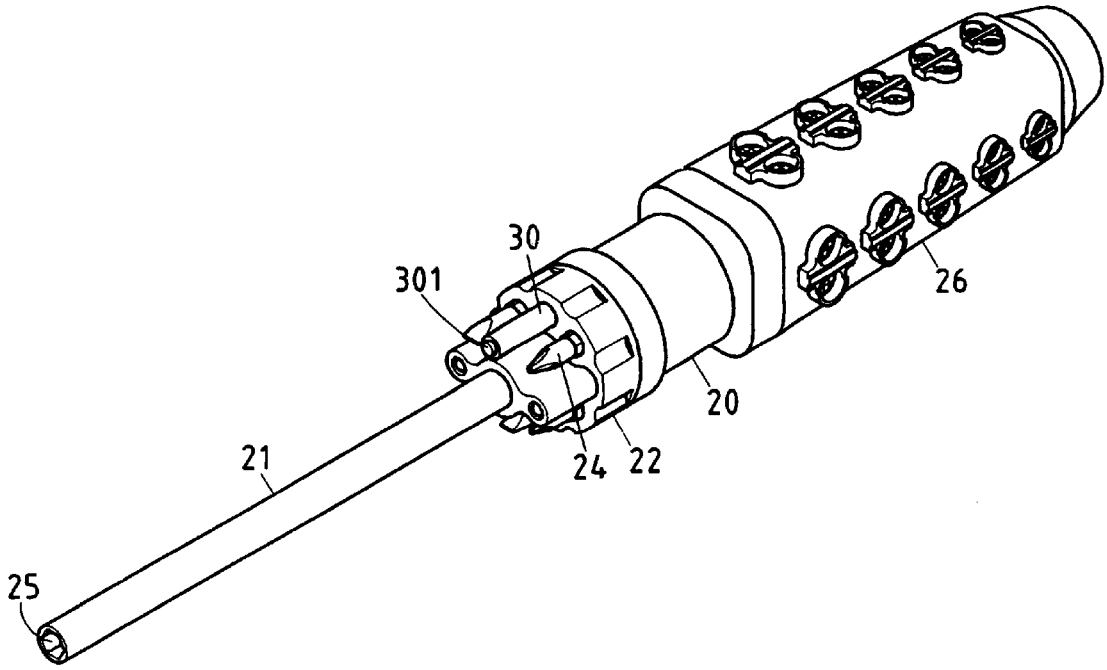
FIG. 4 shows a perspective view of a screwdriver of the preferred embodiment of the present invention.
Figure 5:
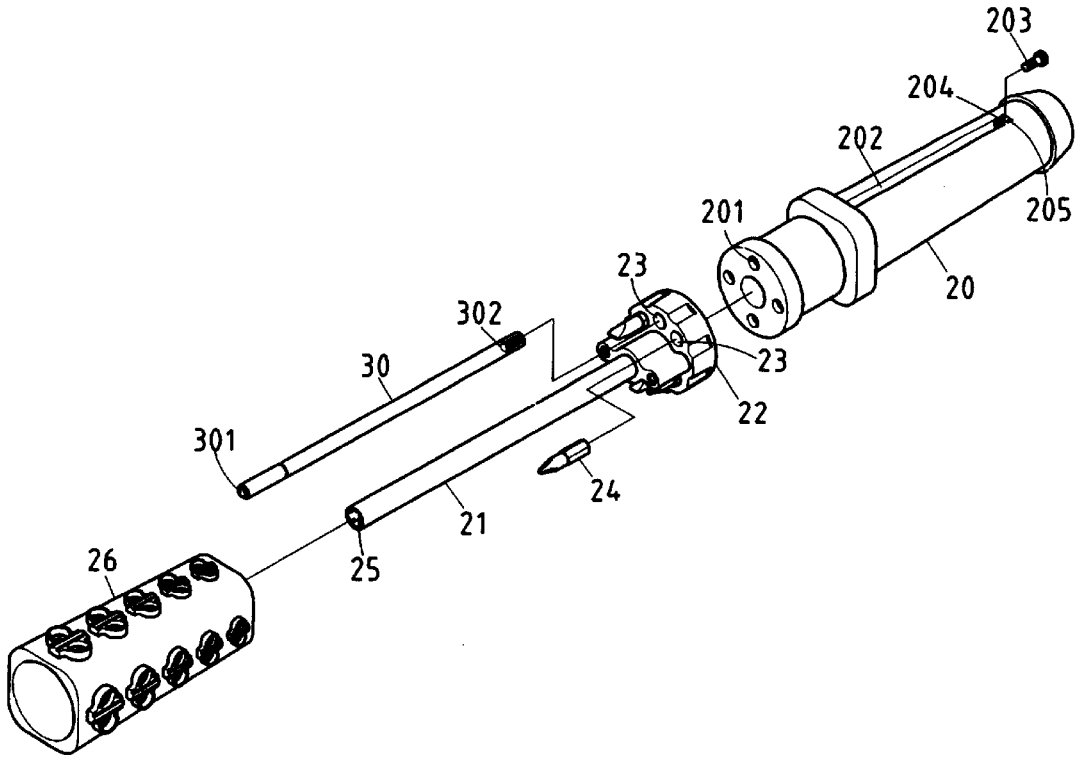
FIG. 5 shows an exploded view of the screwdriver of the preferred embodiment of the present invention.
Figure 6:
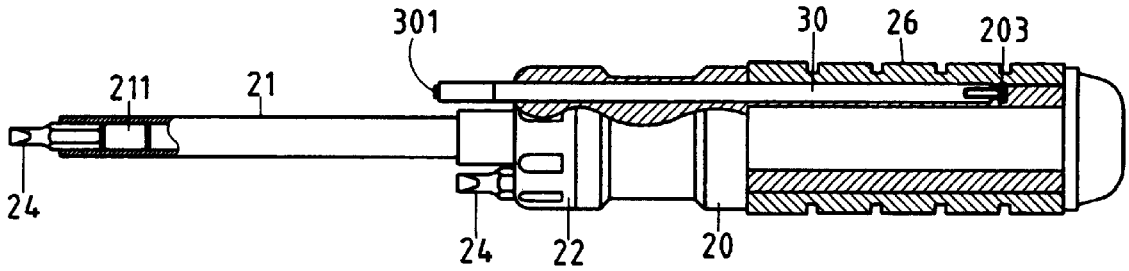
FIG. 6 shows a longitudinal sectional view of the screwdriver of the preferred embodiment of the present invention in combination.
Figure 7:
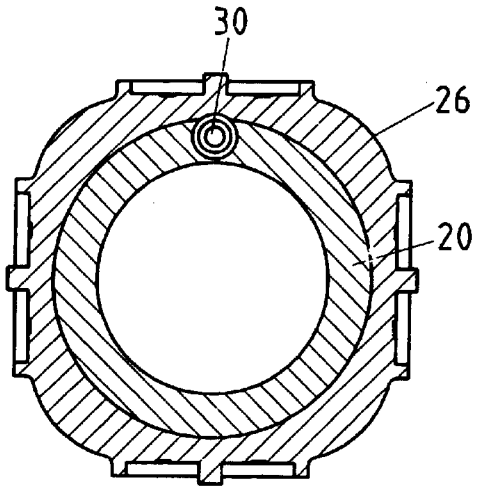
FIG. 7 shows a cross sectional view of the screwdriver of the preferred embodiment of the present invention in combination.

As shown in FIGS. 4–6, a screwdriver embodied in the present invention comprises a handle 20, a shank 21, and a locating seat 22 which is provided with a plurality of receiving holes 23 for receiving a tip 24. The shank 21 is provided at the free end thereof with an opening 25 for fastening the tip 24.

The handle 20 has a through hole 201 which is in communication with one of the receiving holes 23 of the locating seat 22 and is extended to reach the bottom end of the handle 20. The handle 20 is provided with a longitudinally-oriented slot 202 in communication with the through hole 201. An expandable magnetic rod 30 is received in one of the receiving holes 23, the through hole 201 and the slot 202 such that the expandable magnetic rod 30 is fastened by a screw 203, and that a magnetic tip 301 of the expandable magnetic rod 30 is exposed from the seat 22. The handle 20 is further provided with a cover 26 fitted thereover. The expandable magnetic rod 30 is provided at the bottom end thereof with a threaded hole 302. The slot 202 is provided at one end thereof with two stop blocks 204 opposite to each other for stopping the expandable magnetic rod 30, and a recess 205 in communication with the slot 202. The recess 205 is used for placing the screw 203 which is engaged with the threaded hole 302.

The opening 25 of the shank 21 is provided therein with a magnetic block 211, as shown in FIG. 6.

Figure 8:
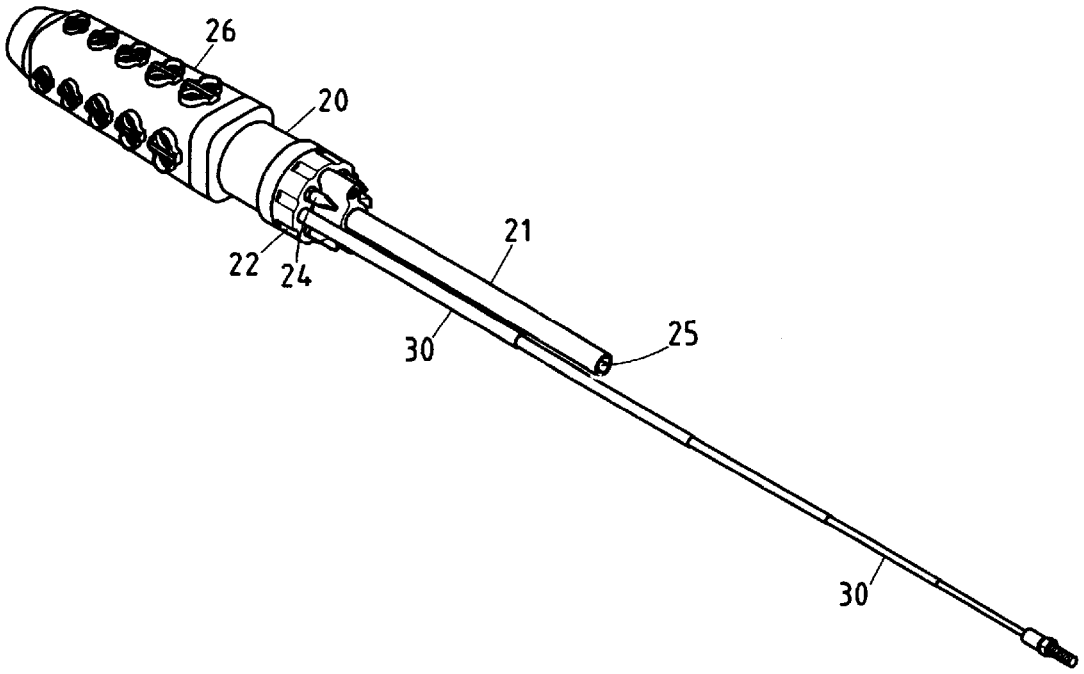
FIG. 8 shows a schematic view of the screwdriver of the preferred embodiment of the present invention in operation.

As illustrated in FIGS. 4, 6 and 8, the tip 24 is received in the opening 25 of the shank 21 such that the tip 24 is located by the magnetic block 211. As a result, the tip 24 of one size can be easily replaced by the tip 24 of another size. The expandable magnetic rod 30 is independently disposed such that the magnetic tip 301 can be extracted or retracted without interfering with the tip 24.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A screwdriver comprising a handle, a shank, and a locating seat which is provided with a plurality of receiving holes for receiving a tip, said shank provided at a free end thereof with an opening for fastening the tip; wherein said handle has a through hole in communication with one of said receiving holes of said locating seat and extending to reach a bottom end of said handle, said handle further provided with a slot extending along the direction of a longitudinal axis thereof and in communication with said through hole, said handle being further provided with an expandable magnetic rod which is received in one of said receiving holes, said through hole, and said slot such that said expandable magnetic rod is fastened by a screw, and that a magnetic tip of said expandable magnetic rod is exposed from said locating seat, said handle further provided with a cover fitted thereover.

2. The screwdriver as defined in claim 1, wherein said expandable magnetic rod is provided at a bottom end thereof with a threaded hole.

3. The screwdriver as defined in claim 1, wherein said slot of said handle is provided at one end thereof with two stop blocks opposite in location to each other for stopping said expandable magnetic rod, and a recess in communication with said slot whereby said recess is used for placing said screw which is engaged with said threaded hole.

4. The screwdriver as defined in claim 1, wherein said opening of said shank is provided with a magnetic block.

* * * * *